US006363705B2

(12) United States Patent
Brenk

(10) Patent No.: US 6,363,705 B2
(45) Date of Patent: Apr. 2, 2002

(54) METHOD FOR JOINING FIBERS ONTO THE FREE ENDS OF TWO THREADS OF A YARN PRODUCED BY AN INTEGRATED OPEN END SPINNING AND TWISTING PROCESS AND A TWO-FOR-ONE SPINNING AND TWISTING APPARATUS FOR PERFORMING THE METHOD

(75) Inventor: Siegfried Brenk, Krefeld (DE)

(73) Assignee: Volkmann GmbH (DE)

( * ) Notice: Subject to any disclaimer, the term of this patent is extended or adjusted under 35 U.S.C. 154(b) by 0 days.

(21) Appl. No.: 09/846,166

(22) Filed: Apr. 30, 2001

(30) Foreign Application Priority Data

Apr. 29, 2000 (DE) ..... 100 21 160

(51) Int. Cl.[7] ..... D01H 4/00
(52) U.S. Cl. ..... 57/409; 57/58.49; 57/263
(58) Field of Search ..... 66/261, 263, 264, 66/301, 302, 400, 404, 405, 406, 408, 411, 409, 58.49, 58.52, 58.7, 58.83, 58.54

(56) References Cited

U.S. PATENT DOCUMENTS 5,479,771 A * 1/1996 Ballhausen et al. ..... 57/406
5,499,496 A * 3/1996 Stenmans ..... 57/406
5,626,011 A * 5/1997 Ballhausen et al. ..... 57/409
6,047,537 A * 4/2000 Beckmann et al. ..... 57/404

FOREIGN PATENT DOCUMENTS

| | | | |
|---|---|---|---|
| DE | 2615505 | * 10/1977 | ..... 57/406 |
| DE | 4431830 | * 10/1995 | ..... 57/406 |
| EP | 0701014 | * 11/1996 | ..... 57/406 |
| FR | 2354403 | * 6/1977 | ..... 57/406 |

* cited by examiner

*Primary Examiner*—Danny Worrell
(74) *Attorney, Agent, or Firm*—R. W. Becker & Associates; R. W. Becker

(57) ABSTRACT

A method for spinning fibers onto the free ends of the two threads of a yarn that is produced during an integrated spinning and twisting process and a two-for-one spinning and twisting apparatus for performing the method are provided. The method includes gripping a twisted yarn, separating two threads of the twisted yarn in a manner such that the twist which was originally present in each individual thread prior to the doubling of the thread with the other thread returns to the now separated thread portion, and forming a thread loop of each separated thread portion. Each thread loop is clamped and respective portions of the two branches of the thread loop extend to a spinning rotor and the spindle hollow axle. Spinning is commenced in coordination with winding and the thread loop is dissolved as the now joined thread is drawn into the spindle hollow axle.

13 Claims, 3 Drawing Sheets

METHOD FOR JOINING FIBERS ONTO THE FREE ENDS OF TWO THREADS OF A YARN PRODUCED BY AN INTEGRATED OPEN END SPINNING AND TWISTING PROCESS AND A TWO-FOR-ONE SPINNING AND TWISTING APPARATUS FOR PERFORMING THE METHOD

BACKGROUND OF THE INVENTION

EP 0 701 014 B1 (U.S. Pat. No. 5,626,011) discloses an apparatus for producing a twist yarn in an integrated open end spinning and twisting process. The apparatus includes a rotatably driven spindle rotor mounted to a machine frame and having a spindle hollow axle that is communicated with a substantially radially outwardly extending yarn guide channel. A yarn traveling outwardly of the yarn guide channel is guided by a balloon limiting device to a centering eye located at an axial extension of the spindle hollow axis and the yarn is thereafter wound on a winding package. Within the area circumscribed by the rotating balloon limiting device, two upwardly opening spinning rotors are supported in side-by-side relationship above the spindle rotor symmetrical to the spindle hollow axis, and fiber material is fed through the yarn balloon to the spinning rotors. The spun yarn produced by the spinning rotors is drawn out of the spinning rotors in a yarn withdrawal direction and guided into a 180° reverse direction to enter into the spindle hollow axle for passage therethrough as noted above in connection with the twisting of the yarn according to the two-for-one principle.

To produce the spun yarn, it is necessary to dispose a joining strand or thread in each spinning rotor. EP 0 701 014 B1 discloses a corresponding method and apparatus for effecting this process of disposing a joining thread in a spinning rotor.

Certain disadvantages are incurred in the use of the joining thread disposition process as described in EP 0 701 014 B1 in the course of an integrated open end spinning and twisting process in that there may be a relatively long extent of the yarn which extends from the joining thread portion of the yarn in which the yarn strands or threads are not twisted with one another. Under certain conditions, this may result in the entire twist yarn package being unusable for further textile operations. This undesired occurrence of such a relatively long extent of untwisted yarn may occur as well in the event of a yarn break.

SUMMARY OF THE INVENTION

The present invention provides a method for spinning fibers onto the free ends of the two threads of a yarn which is produced during an integrated spinning and twisting process and a two-for-one spinning and twisting apparatus for performing the method such that, immediately after the commencement of the spinning process, the twisted yarn which is produced exhibits no extent of non-twisted yarn or, at most, only a very short extent of non-twisted yarn.

In the implementation of the method of the present invention, the clamping of the individual threads, which involves clamping a thread loop formed from the yarn extending from the spindle hollow axle and having a first branch of the thread loop extending into a spinning rotor and a second branch extending into the spindle hollow axle, ensures that the twist imparted to the spun yarn by the open end spinning process is maintained, whereby a curling of the spun yarn in the area of the thread loop is prevented.

The twist imparted by the open end spinning process can only become undone along the yarn over a relatively short end portion thereof—namely, in that portion of the spun yarn which lies between the clamping location of the thread loop and the free end of the first branch of the thread loop which has been disposed in the spinning rotor. This free thread end is typically inserted sufficiently into the spinning rotor so as to ensure that, at the commencement of the feed of fiber material into the spinning rotor, the free thread end is at a spacing from the fiber collecting rim of the spinning rotor and continues to remain in the spinning rotor in spite of the centrifugal force applied thereto due to the spinning of the spinning rotor.

If sufficient fiber material is fed into the spinning rotor during a spinning operation, then a spin joining process will occur in which the first branch of the thread loop which had been inserted into the spinning rotor is joined by the fiber material and, in connection with this operation, the further drawing in of the second loop branch into the spindle hollow axle due to the commencement of the winding operation leads to the dissolution of the thread loop, whereby those free ends of the threads in the spinning rotors which were formerly the first branches of the thread loops and the spun fibers which have been joined therewith by the spinning operation are drawn into the spindle hollow axle and are thereafter followed by spun yarn produced by the spinning rotors, and twist is imparted to the thus formed yarn by the two-for-one spinning and twisting apparatus.

At the commencement of the open end spinning operation during which the free end of the one thread—i.e., the first branch of the thread loop—is disposed in the spinning rotor, a spin direction is imparted to the free thread end by the spinning rotor, whereby, immediately following the spin joining operations in the two spinning rotors, the two threads having the required spin direction for the subsequent two-for-one twisting operation are now available.

The disposition of the free thread ends into the individual spinning rotor or, respectively, its fiber collecting rim can be additionally facilitated by the clamping of the thread loop—that is, the clamping of the first and second branches of the thread loop between the stationary and movable clamp plates—and the passage of the first and second branches of the thread loop through the nip of the set of rollers of the delivery device, whereby the first branch of the thread loop is guided into the spinning rotor and the second branch of the thread loop is guided into the spindle hollow axle.

If during the spin joining operation, which begins after the commencement of the winding operation, the twisting of the yarn in the two-for-one twisting process begins, the two threads, whose free ends in the spinning rotors will have fiber material joined thereto, are drawn into the spindle hollow axle, whereby the rollers of the delivery devices are positively set into rotation so as to facilitate the delivery of the free thread ends into the spinning rotors.

BRIEF DESCRIPTION OF THE DRAWINGS

The object and advantages of the present invention will be explained in more detail with the aid of the accompanying schematic drawings, in which.

DETAILED DESCRIPTION OF THE PREFERRED EMBODIMENT

Figure 1:
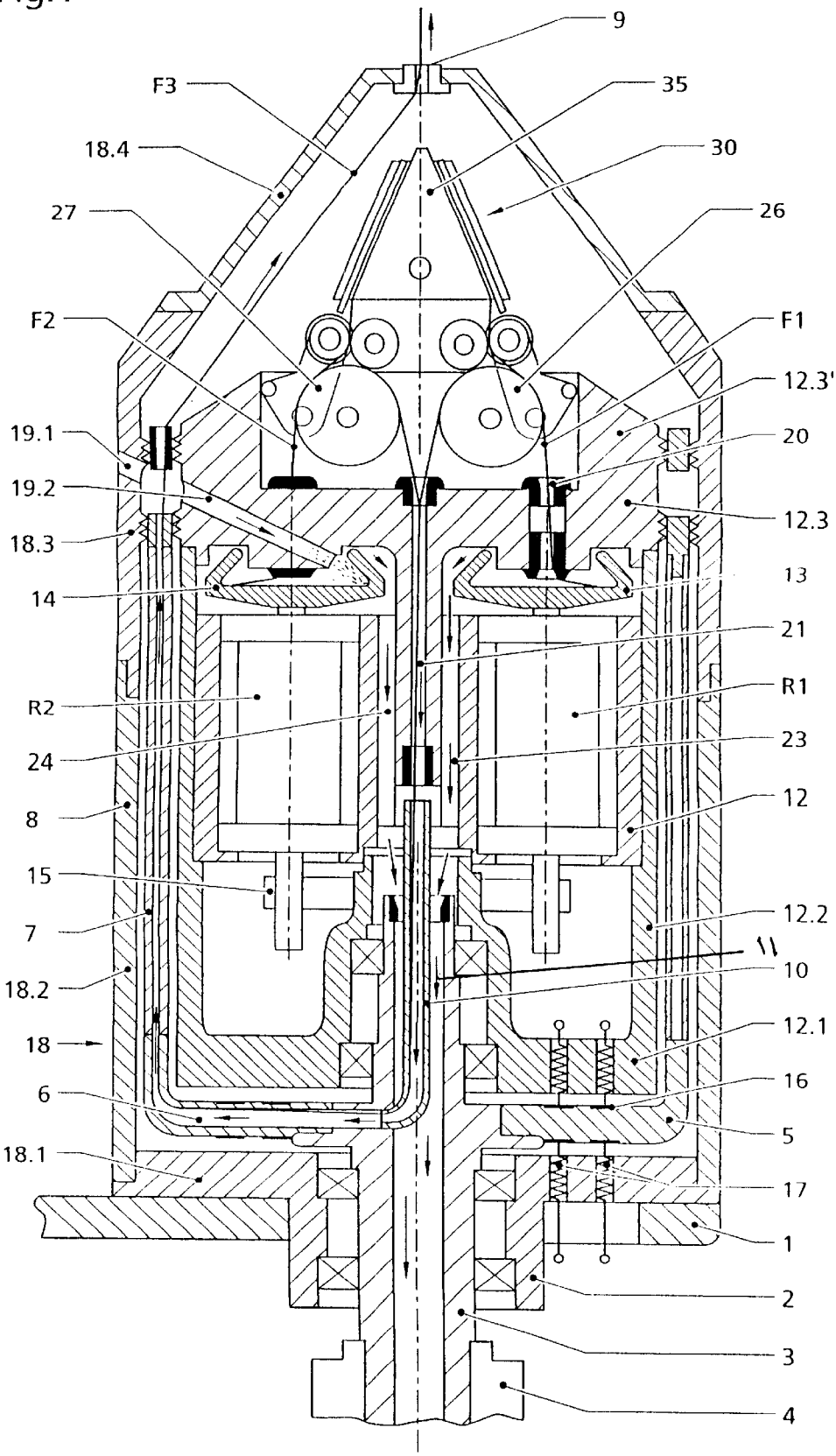
FIG. 1 is a sectional view of the one embodiment of the two-for-one spinning and twisting apparatus of the present invention having integrated spinning components in the form of open end spinning rotors.

The method and one embodiment of the apparatus of the present invention are described with respect to FIGS. 1–4 in which, as can be seen in FIG. 1, a hollow shaft 3 is rotatably supported by means of a bearing block 2 on a spindle bank 1 which is representative of a textile machine frame. The outer end of the hollow shaft 3—that is, the lower end as illustrated—is connected to a vacuum source which is not shown. The hollow shaft 3, which is rotatably driven by a whorl 4 around which is trained a tangential drive belt (not shown), supports a radially outwardly oriented spindle rotor disc 5 having a substantially radially extending yarn guide channel 6. A balloon limiting top or twisting pot 7 is mounted to the outer circumference of the spindle rotor disc 5 and has a wall in which is formed an upwardly extending yarn guide channel whose lower end is communicated with the yarn guide channel 6 and an upper end from which a yarn F3 extends to a centering eye 9.

A central yarn guide channel 10, which is part of a spindle hollow axle, has an angled lower end which communicates with the radially inner end of the yarn guide channel 6. The central yarn guide channel 10 is disposed in the spindle hollow axle such that air channels 11 have free passage past the central yarn guide channel in the space between the hollow shaft 3 and the central yarn guide channel. The spindle rotor is thus comprised in the main of the following components: the hollow shaft 3, the spindle rotor disc 5, the twisting pot 7 having the yarn guide channel 8, and the central yarn guide channel 10.

A substantally closed inner housing or spinning pot 12 is support ed by suitable bearings at the up per end of the hollow shaft 3 and is secured against rotation by, for example, permanent magnets (not shown). The spinning pot 12 has a base 12.1, a cylindrical housing 12.2, and a cover 12.3. Two rotor spinning devices R1, R2 or, respectively, open end spinning assemblies, are disposed in the spinning pot 12 and the respective spinning rotors 13, 14 thereof are open on their tops and driven via a drive belt 15 drivingly connected to a motor (not shown). The energy supply to the motor is effected via the spindle rotor disc 5 through a system, shown schematically, comprising sliding ring contacts 16, 17 with associated electrical connectors.

An outer housing 18 encircles the spindle rotor and comprises a base 18.1, a lower cylindrical housing portion 18.2, an upper cylindrical housing portion 18.3, and a removable cover 18.4 which supports thereon the centering eye 9.

A fiber feed channel has an end disposed for feeding fiber into the spinning rotor 14 and includes a channel portion 19.1 extending through the spinning pot cover 12.3 and a channel portion 19.2 extending through the upper cylindrical housing portion 18.3 of the outer housing 18. Fiber is fed to the spinning rotor 13 by a similarly configured fiber feed channel arrangement (not shown).

Each spinning rotor 13, 14 has a yarn withdrawal channel 20 associated therewith of which only the yarn withdrawal channel 20 associated with the spinning rotor 13 is shown. The spun yarns F1, F2 produced in the spinning rotors 13, 14, respectively, are withdrawn from the spinning rotors through their respective associated yarn withdrawal channels and thereafter trained around directional rollers 26, 27 before these spun yarns enter the upper end of the downwardly extending spindle hollow axle 21 which is communicated at its lower end with the upper end of the central yarn guide channel 10. Each one of a pair of air channels 23, 24 is communicated at its lower end with the inner or upper end of the hollow shaft 3 and is communicated at its upper end with the interior space adjacent the spinning rotor 13, 14, respectively, in the interior of the spinning pot 12. As a result of this arrangement, the feed of fiber material via the fiber feed channels 19 into the spinning rotors 13, 14 can be effected by the creation of suction air in the hollow shaft 3 by vacuum action.

Figure 2:
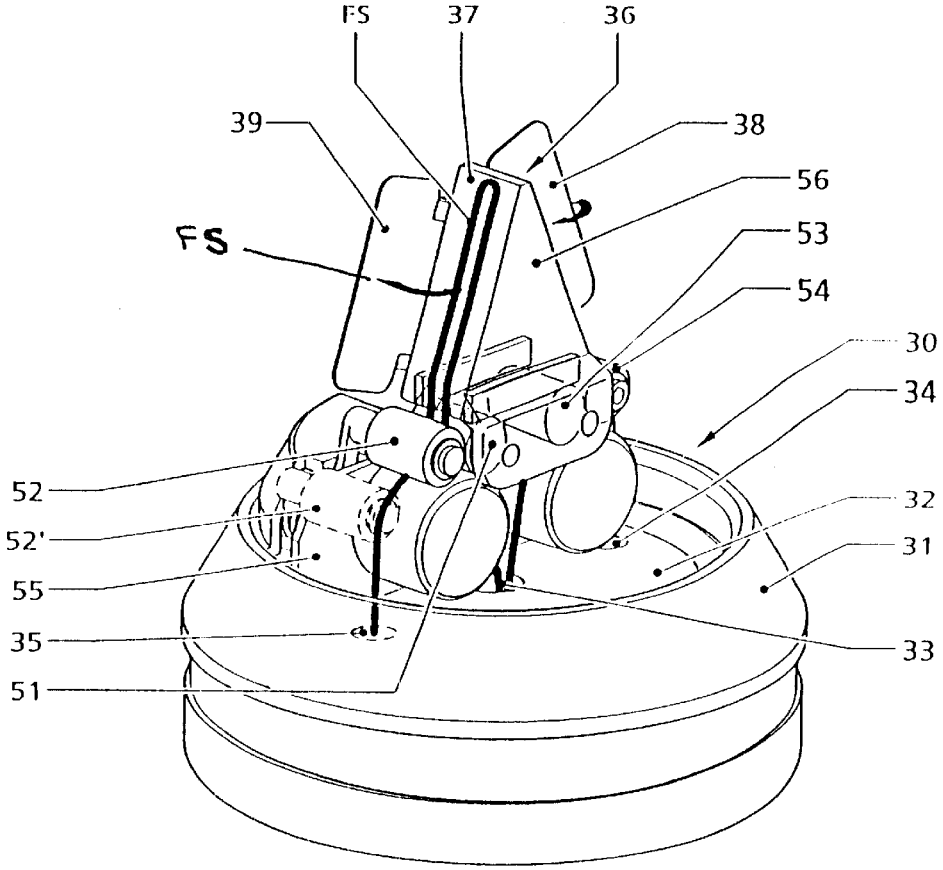
FIG. 2 is an enlarged perspective view of the spin joining components of the two-for-one spinning and twisting apparatus of the present invention.
Figure 3:
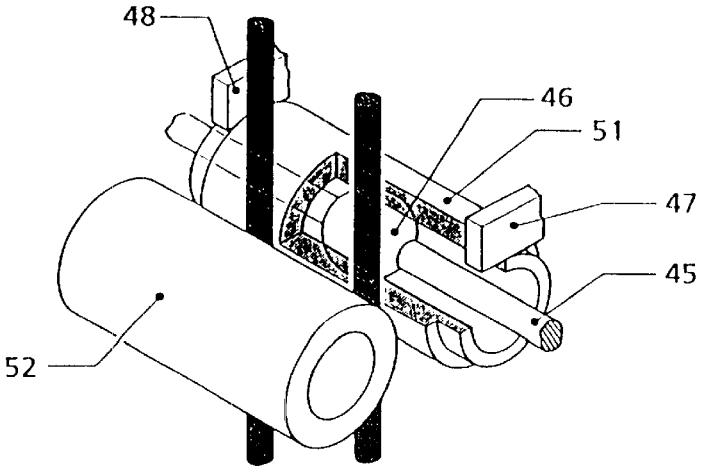
FIG. 3 is an enlarged perspective view of details of the spin joining components shown in FIG. 2.
Figure 4:
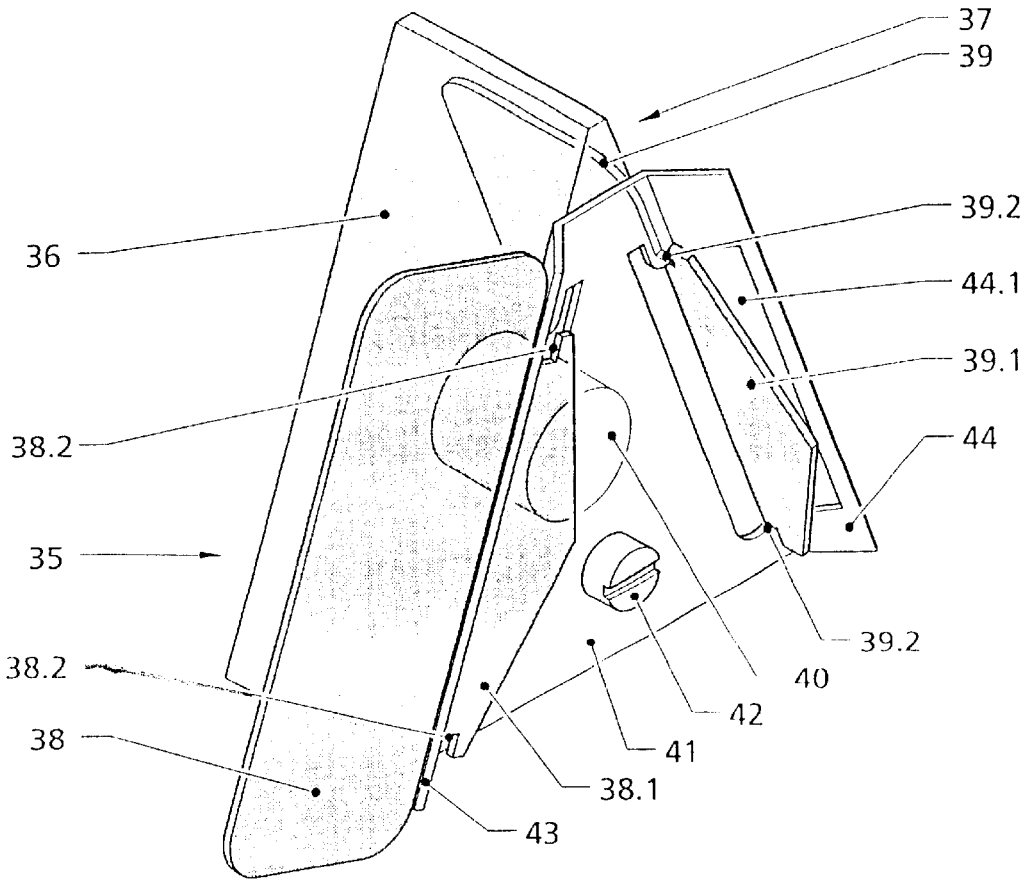
FIG. 4 is an enlarged perspective view of other details of the spin joining components shown in FIG. 2.

A spin joining device 30, which is shown in particular in FIGS. 2–4, is mounted in a recessed portion 12.3' on the top side of the cover 12.3.

As seen in FIG. 2, the spin joining device 30 is comprised of a substantially rotationally symmetrical base 31, the bottom 32 of which has a central opening 33 formed therein which is coaxial with the spindle hollow axle 21 and side openings 34, 35 each of which connects to the associated yarn withdrawal channel 20 of the spinning rotor 13, 14, respectively.

A support plate 55 is mounted on the bottom 32 of the base 31 on which are mounted further substantial components of the spin joining device 30 comprising, in addition to two directional rollers 26, 27 previously mentioned, two delivery devices as well as two clamp devices.

The clamp devices are comprised of a substantially ridged roof shaped block 56 whose pair of sloped surfaces form clamp surfaces 36, 37. Each clamp device has a clamp plate 38, 39, respectively, mounted adjacent the clamp device for movement relative to the clamp device. Each clamp plate 38, 39 is comprised of magnetic material and is mounted in a floating manner. Each clamp plate 38, 39 is provided with a rearwardly oriented tab 38.1, 39.1, respectively, each of which has a pair of cut ins 38.2, 39.2, each formed at one of the spaced apart ends of the respective tab at the transition location between the tab and the respective clamp plate 38, 39. A plate 41 is secured by means of a screw 42 to the block 56. The plate 41, in correspondence with the ridge superface of the block 56, has the form of an equilateral triangle two of whose legs extend parallel to the angularly extending clamp surfaces 36, 37. Wings 43, 44 extend outwardly from these two legs of the plate 41 at an angle from the block 56, each of the wings having, as is shown with respect to the wing 44, a lengthwise extending, substantially right angled cut out 44.1. The tab 38.1, 39.1 of the clamp plate 38, 39, respectively, extends into a cut out 44.1 and is mounted in a hinge manner to the plate 41 at its cut in 38.2, 39.2, respectively. Each clamp plate 38, 39 is thus movable between a clamping position and an open non-clamping position.

Each of the pair of delivery devices has two rollers 51, 52 or 53, 54, respectively, wherein one of each set of rollers can be swung away from the other roller of the set as is representatively shown by the broken line representation 52' of the roller 52 in its swung away position. Each set of rollers 51, 52 and 53, 54, respectively, of the delivery devices are configured such that the roller gap or nip formed by the respective set of rollers is immediately adjacent the lower end of the clamp surfaces of one of the thread feed elements.

The movably mounted roller 52 or 54, respectively, of each delivery device is preferably resiliently biased such that the roller is resiliently biasable against its counter roller.

As seen in FIG. 3, the roller 51 is configured as a hollow cylindrical body which is rotatably supported on its inner wall on a ball shaped support body 46 mounted on an axle 45, the ball shaped support body 46 preferably being spherically shaped. Stop elements 47, 48 contact respective opposite axial ends of the outer circumferential surface of the roller 51 and the stop elements 47, 48 extend parallel to the plane passing through the axes of the rollers 51, 52 and perpendicular to the roller nip of the delivery device. In this manner, it is ensured that the position of the roller 51 can only change relatively about a perpendicular axis in a plane which is defined by the axes of the two rollers while the contact of the stop elements 47, 48 on the top side of the roller 51 prevent a swinging or tilting movement of the roller 51 about a horizontal axis lying in a plane which is tangential to the area of the outer circumferential surfaces of the two rollers 51, 52 as they form the roller nip.

The purpose of, on the one hand, the thread feed element having cooperatively functioning clamp surfaces and, on the other hand, the delivery devices having the roller-counter roller sets is hereinafter explained in the description of a spin joining process.

In the event of a yarn break or in the event of a beginning winding of a winding package, a twisted yarn is drawn through the centering eye 9 in the cover 18.4 while the cover 18.4 is in a removed condition from the outer housing and the twisted yarn is thereafter threaded downwardly through the yarn guide channel 6, along the radially extending portion of the yarn guide channel 6, and upwardly along the central yarn guide channel 10 and thereafter beyond the spindle hollow axle 21. The extent of the twisted yarn which extends outwardly from the open upper end of the spindle hollow axle 21 is preferably gripped at a location such that there is still available a complete intact segment of the twisted yarn having the twist. Thereafter, the segment is untwisted over a predetermined extent whereby the twist which was originally present in the individual strands or threads of the twisted yarn returns to the individual threads. Then, the threads, which now extend parallel to one another, are separated from one another, cut to the length required for the subsequent process steps, and the ends of the threads are then "fixed". The "fixing" of the ends of the threads is to be understood in this connection as handling the ends of the threads such that it is ensured that the original twist which has returned to each of the two threads is maintained over the complete extent of the thread. Each "fixed" thread is then placed, in the form of a loop FS with two branches extending parallel to one another, onto the stationary clamp surfaces 36, 37 and the movable clamp plates 38, 39 are moved into their clamping positions such that the loops of the "fixed" threads are clamped. As a result of the floating positions of the movable clamp plates 38, 39 under the influence of the permanent magnets 40, an optimal, uniform clamping of both loops is ensured even if there are thickness differences of the loop shaped clamped yarn extents.

In connection with disposing the thread loops onto the stationary clamp plates, both of the loops are, at the same time, each disposed between a set of rollers 51, 52 or 53, 54 of a respective delivery device, whereby, to facilitate this placement of the loop ends between the set of rollers, the respective movable roller of each set of rollers has been swung away from its counter roller.

The floating mounting of the roller 51 or 54 of the delivery devices ensures that both loops are constantly securely clamped between the set of rollers of the respective delivery device independent of the thickness difference of the threads.

An extent of the free thread end extending from each respective delivery device is placed into the yarn withdrawal channel 20 of the respective associated spinning rotor to a sufficient length to ensure that, at the time before the beginning of fiber feed to the rotating spinning rotor, the thread end still remains within the spinning rotor hollow axis or, respectively, the yarn withdrawal channel despite the centrifugal forces imposed thereon by the rotating spinning rotor.

Once sufficient fiber material has been fed into the rotating spinning rotor, then precisely at that time the winding apparatus which handles the yarn from the two-for-one twisting spindle is actuated, whereby the two threads are drawn into the spindle hollow axle. This leads to the result that the one thread loop branch of each thread disposed in the spindle hollow axle sets in motion the respective delivery device which handles the thread loop while, at the same time, the free end of the other thread loop branch of the thread (which is disposed in the respective spinning rotor space) is moved by centrifugal force in the direction of the fiber collecting rim of the spinning rotor.

Once the thread loop has been dissolved, which coincides with the time at which the spinning process has commenced, the direction of movement of the one thread loop, which has heretofore been disposed in the spinning rotor, reverses, whereby the two thread joining ends, which are comprised of the free thread end initially disposed in the spinning rotor together with fiber that has been spun onto the free thread end, are then drawn into the spindle hollow axle. Due to the clamping of the thread loop, on the one hand, in the area of the clamp surfaces and, on the other hand, in the nip of the set of rollers of the delivery device immediately adjacent the clamping surfaces, it is ensured that, on one side, the spin direction in the individual threads up to the nip of the set of rollers is maintained, whereby, in addition, a curling of the individual threads in the area of the thread loop is prevented. In this connection, care should be taken that the two thread loop branches are clampedly secured in a sidewise spacing from one another.

An unwinding of the spin direction is thus possible only along the relatively short spinning yarn segment between the nip of the set of rollers of the delivery device and the free thread end which has been disposed in the spinning rotor. During the spinning operation, however, the spinning direction imparted by the open end spinning rotor extends as well along the former free thread end, whereby, in connection with the spinning process, two threads having the required spin direction for the two-for-one twisting process are available immediately therefollowing.

It is thus achieved, in this manner, that immediately after the commencement of the spinning process, the twisted yarn which is produced does not exhibit any relatively long extents of non-twisted yarn.

The specification incorporates by reference the disclosure of German priority document 100 21 160.7-26 of Apr. 29, 2000.

The present invention is, of course, in no way restricted to the specific disclosure of the specification and drawings, but also encompasses any modifications within the scope of the appended claims.

What I claim is:

1. A method for spinning fibers onto the free ends of the two threads of a yarn that is produced during an integrated spinning and twisting process performed by a two-for-one spinning and twisting apparatus having a yarn guide channel, a spindle hollow axle, a spindle rotor disc, and a pair of spinning rotors, the method comprising:

threading a twisted yarn end, in a direction opposite to the travel direction of the twisted yarn end during the twisting operation, through a yarn guide channel of a spindle rotor disc and thereafter through the spindle hollow axle until an extent of the twisted yarn end extends beyond the inlet upper end of the spindle hollow axle with its twist substantially unreleased;

gripping the twisted yarn at a location thereon below the extent of the twisted yarn end which extends beyond the inlet upper end of the spindle hollow axle;

in the extent of the twisted yarn above the gripped location, separating from one another into parallel extending portions the two threads of the twisted yarn in a manner such that the twist which was originally present in each individual thread prior to the doubling of the thread with the other thread returns to the now separated thread portion;

forming a thread loop of each separated thread portion in the area between the inlet upper end of the spindle hollow axle and a respective one of the spinning rotors;

clamping each thread loop in a clamping device such that the trough of the thread loop is clamped and respective portions of the two branches of the thread loop extending from the trough are clamped in parallel relation to one another;

disposing a first branch of each thread loop into the respective spinning rotor while a second branch of the thread loop extends into the spindle hollow axle;

commencing the winding operation such that the second branch of each respective thread loop is drawn further into the spindle hollow axle; and commencing spinning of fiber material in the pair of spinning rotors in correspondence with the dissolution of the thread loops due to the further drawing in of the second thread loop branches into the spindle hollow axle, whereby those free ends of the threads in the spinning rotors which were formerly the first branches of the thread loops and the spun fibers which have been joined therewith by the spinning operation are drawn into the spindle hollow axle and are thereafter followed by spun yarn produced by the spinning rotors, and twist is imparted to the thus formed yarn by the two-for-one spinning and twisting apparatus.

2. A method for spinning fibers according to claim 1, wherein the step of clamping each thread loop includes clamping the thread loops at a sidewise spacing from one another.

3. A method for spinning fibers according to claim 1, wherein the two-for-one spinning and twisting apparatus includes a pair of delivery devices each having a pair of rollers forming a nip therebetween and further comprising disposing the first and second thread loop branches of each thread loop in the nip of the set of rollers of the respective delivery device prior to commencing the winding operation.

4. A two-for-one spinning and twisting apparatus for producing a yarn having a twist wherein the yarn is produced during an integrated spinning and twisting process in which fibers are spun onto the free ends of the two threads of a yarn, comprising:

a hollow spindle shaft extending centrally;

a spindle hollow axle coaxially mounted on the hollow spindle shaft for rotation therewith;

a twisting pot having a radially and axially extending yarn guide channel formed therein;

a spindle rotor disc mounted concentric to the spindle hollow axis and supporting the twisting pot thereon;

a spinning pot;

a pair of spinning rotors arranged sidewise to one another at symmetrical radial spacings from the spindle hollow axle and operable to spin fiber fed thereto in an open end spinning operation;

a pair of yarn withdrawal channels each mounted relative to a respective one of the spinning rotors for withdrawal of a spun yarn through the withdrawal channel;

a pair of directional rollers each associated with a respective spinning rotor and operable to guide therearound a spun yarn withdrawn through a yarn withdrawal channel from the spinning rotor to thereby reverse the travel direction of spun yarn from its withdrawal direction whereupon the spun yarn travels into the spindle hollow axle; and a pair of thread loop holding elements each for releasably holding a thread loop formed of a thread extending from the spindle hollow axle, each thread loop having a first branch disposable in a respective one of the spinning rotors and a second branch extending to the spindle hollow axle, each thread loop holding element having:

a stationary clamp surface, a movable clamp plate each mounted relative to a respective one of the clamp surfaces for movement between a clamping position in which the clamp plate and the clamp surface compressively retain a thread loop therebetween and an open position in which the clamp plate has been swung away from the clamp surface, and a delivery device having a set of roller forming a nip therebetween and positioned relatively between the directional roller and the yarn clamping location formed by the stationary clamp surface and the movable clamp plate such that the nip engages the first and second branches of the thread loop substantially immediately beyond the yarn clamping location.

5. A two-for-one spinning and twisting apparatus according to claim 4, wherein each movable clamp plate is mounted in a floating manner which permits limited movement of the clamp plate in a direction other than relatively about the axis about which the clamp plate is moved between its clamping position and its open position and further comprising magnetic means for moving each clamp plate from its open position to its clamping position.

6. A two-for-one spinning and twisting apparatus according to claim 5, wherein the magnetic means includes a permanent magnet associated with each clamp plate and each clamp plate is comprised of magnetic material.

7. A two-for-one spinning and twisting apparatus according to claim 4, wherein each stationary clamp surface is formed by a respective sloping surface of a ridged roof shaped block.

8. A two-for-one spinning and twisting apparatus according to claim 4, wherein one roller of each set of rollers is movable relative to the other roller between a nip forming position and an open position in which the set of rollers are spaced further apart from each other than in the nip forming position.

9. A two-for-one spinning and twisting apparatus according to claim 8, wherein the movable roller is resiliently biased against the other roller in the nip forming position.

10. A two-for-one spinning and twisting apparatus according to claim 4, wherein one roller of each set of rollers is movable relative to the other roller between a nip forming position and an open position in which the set of rollers are spaced further apart from each other than in the nip forming position, the one movable roller being mounted in a floating manner which permits limited movement of the roller in the nip forming position only in the plane in which the axes of both rollers of the set of rollers lie.

11. A two-for-one spinning and twisting apparatus according to claim 10, wherein the movable roller has a cylindrical interior wall defining a hollow cylindrical interior of the roller and further comprising a pair of ball shaped support bodies each mounted on an axle, each ball shaped support body being disposed in the hollow interior of one of the movable rollers for rolling movement of the cylindrical interior wall of the roller along the support body.

12. A two-for-one spinning and twisting apparatus according to claim 11, wherein each ball shaped support body has a spherical shape.

13. A two-for-one spinning and twisting apparatus according to claim 11, and further comprising a pair of stop elements associated with each movable roller, the pair of stop elements each being disposed adjacent a respective axial end of the movable roller parallel to the plane in which the axes of both rollers of the set of rollers lie and perpendicular to the nip.

* * * * *